United States Patent [19]

Logan

[11] 4,138,887

[45] Feb. 13, 1979

[54] DRILLING MUD LEVEL MONITOR AND ALARM

[75] Inventor: Robert W. Logan, Calgary, Canada

[73] Assignee: Chimo Equipment Ltd., Calgary, Canada

[21] Appl. No.: 857,789

[22] Filed: Dec. 5, 1977

[51] Int. Cl.[2] ..... E21C 1/00

[52] U.S. Cl. ..... 73/151

[58] Field of Search ..... 73/151, 155, 301; 324/2; 175/48

[56] References Cited

U.S. PATENT DOCUMENTS 2,832,566 4/1958 Bielstein ..... 73/155

*Primary Examiner*—Anthony V. Ciarlante

*Attorney, Agent, or Firm*—Christie, Parker & Hale

[57] ABSTRACT

Air under pressure feeds through a pin-to-box casing collar of a surface casing and into the drilling mud space inside. Drilling mud within the casing opposes air pressure in the line. When drilling mud level drops too low, air pressure in an air supply line to the collar falls below a threshold level and an alarm will sound, a chart recorder will record the event and its duration, and warning lights will flash. The chart recorder records the history of the pressure in the air supply line to indicate either an adequate drilling mud level or an inadequate level and plots these facts as a function of time. The air flow rate can quantitatively be determined by a rotometer. The rate at which air flows through the line can be adjusted.

9 Claims, 2 Drawing Figures

DRILLING MUD LEVEL MONITOR AND ALARM

BACKGROUND OF THE INVENTION

The present invention relates to the art of instrumentation of a petroleum well during drilling and, more in particular, to a device to monitor the level of drilling mud in a hold being drilled.

Drilling mud in petroleum wells being drilled provides a substantial column of high gravity fluid that resists the pressure of downhole formation fluid and prevents the latter fluid from escaping the well and causing a blowout. Drilling mud also carries away chips generated in the drilling zone by a drilling bit and lubricates the bit. Drilling mud passes down through a drill string and exits at the base of the string into the formation being drilled. The mud returns to the surface, typically between a casing and the drill string. On the surface the mud is cleansed of the cuttings.

If the level of drilling mud gets too low the resistance to blowout decreases and the risk of blowout increases. When tripping pipe of a drill string, it is desirable to let the mud level drop a little so that pipe sections come from the hole comparatively dry and mud is not wasted. However, if the level drops too low, blowout can occur.

U.S. Pat. No. 2,832,566 to Bielstein discloses a means for monitoring the level of drilling mud in a hole. This patent uses a column of drilling mud in an annulus between a drill string and a casing to oppose a column of air in communication with the column of drilling mud. The level of the drilling mud varies in service. The column of drilling mud in opposition to the air varies in accordance with these variations. The patentee teaches the use of air pressure balancing the column of drilling mud as being an indication of the level of drilling mud. When the pressure drops to atmospheric indicating no drilling mud opposition, a pressure switch closes a circuit to alarm devices.

Bielstein's sytem does not provide a record of drilling mud level as a function of time. Further, there is no indication of air flow rate and so there is no continuous indication of drilling mud level.

SUMMARY OF THE INVENTION

The present invention provides a means for determining the level of drilling mud in a hole and a record of the level of the drilling mud over a period of time. It also provides a means for instantaneously determining about what the drilling mud level is in the hole.

In one form the present invention contemplates the use of a column of air opposed by a column of drilling mud above an injection zone of the air into the mud. This zone may be in a collar between a pin and box of a surface casing joint or any other casing string joint located at some predetermined point below the surface, say 100 to 200 feet. Means is provided to supply air to the column. Resistance to air flow into drilling mud manifests as static pressure in the air line. A pressure switch responds to a predetermined low pressure corresponding to a dangerously low drilling mud level and establishes a circuit to an alarm and a setting on a chart recorder corresponding to the low condition. When drilling mud level is proper, the alarm is out of circuit, but the chart recorder is in a circuit and records the fact of a safe level of drilling mud. The chart recorder, then, gives a plot of drilling mud level, as safe or not safe, as a function of time. Means are provided to adjust the air flow through the line and to note the amount of flow through the line. These means may comprise, respectively, a valve and a rotometer.

Thus the present invention provides a monitor for drilling mud that gives a warning by an alarm when drilling mud level in a hole falls dangerously low. This gives the operator time in such situations where drilling mud level drops with loss of mud circulation. It also provides a continuous time record of drilling mud level as acceptable or unacceptable. The drilling mud level is instantaneously gaged even at safe levels to help monitor the level during such exercises as tripping pipe into or out of the hole.

These and other features, aspects and advantages of the present invention will become more apparent from the following description, appended claims and drawings.

DESCRIPTION OF THE PREFERRED EMBODIMENT

Figure 1:
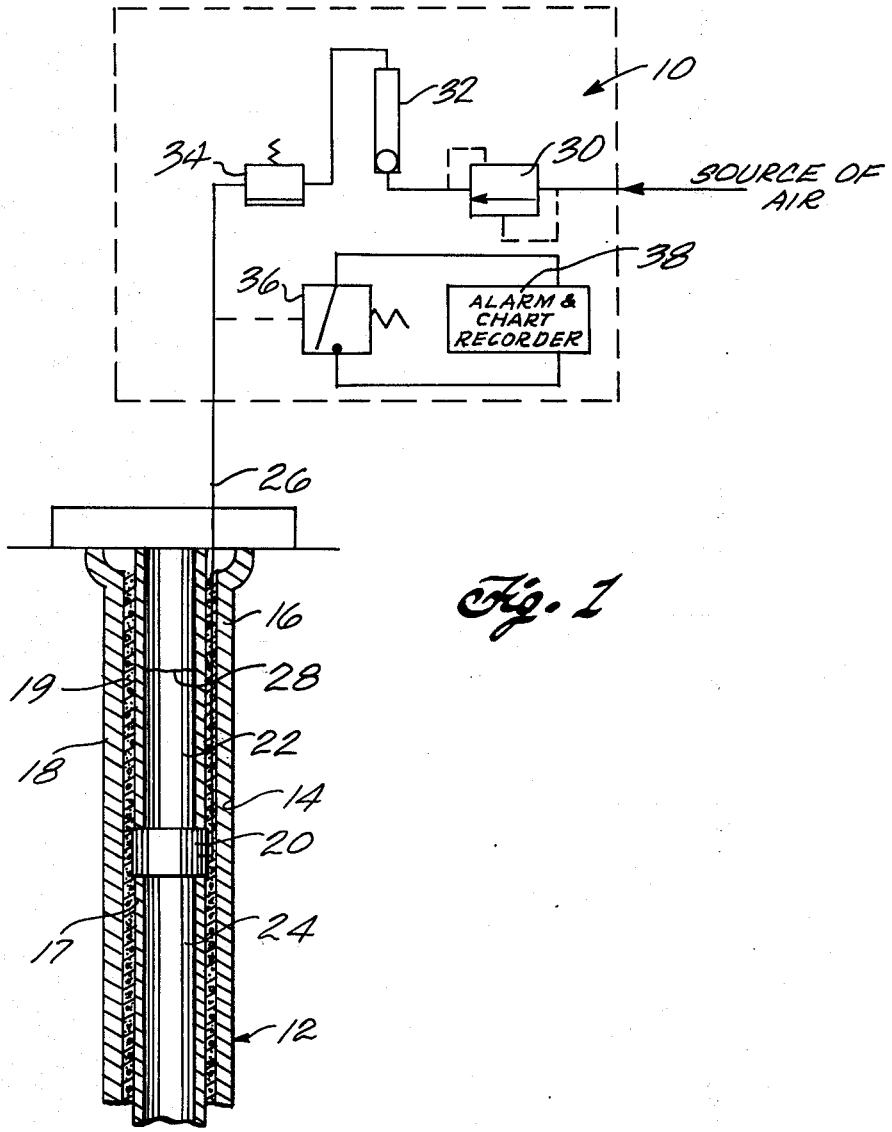
FIG. 1 is a schematic showing a hole and surface casing of the well and the monitor in place.

With reference to FIG. 1, a drilling mud monitor 10 monitors the level of drilling mud in a well 12 under construction. The well under construction includes a hole 14. A surface casing 16 lines the hole near the surface. The casing includes inner and outer liners 17 and 18, with an annulus between them filled with concrete 19. A collar 20 between pipe sections 22 and 24 of liner 17 secures in the pin-to-box connection normally employed between pipe sections.

An air line 26 communicates air to the inside of the collar. Drilling mud circulates inside casing 16 on the outside of a drill string. The level of the drilling mud usually is above collar 20, the collar being located some 100 to 200 feet down the hole. The level of drilling mud is arbitrarily shown at 28. This level provides a resistance for air flowing into the casing and bubbling up through the drilling mud. This resistance is manifested as pressure in line 26. The greater the resistance, the greater the pressure in line 26, up to the pressure of the source of air. As will be developed subsequently, when the pressure in line 26 becomes too low because of a drop in the level of drilling mud, a pressure switch senses the drop in pressure and triggers an alarm and an alternate reading in a chart recorder.

A regulator 30 in line 26 establishes a predetermined pressure downstream of the regulator. A rotometer 32 in line 26 indicates the flow rate of air through the line. An infinitely adjustable valve 34 in line 26 downstream of rotometer 32 permits an adjustment of the flow rate in the line. A pressure switch 36 sensing the pressure in line 26 controls an alarm and chart recorder circuit 38.

Figure 2:
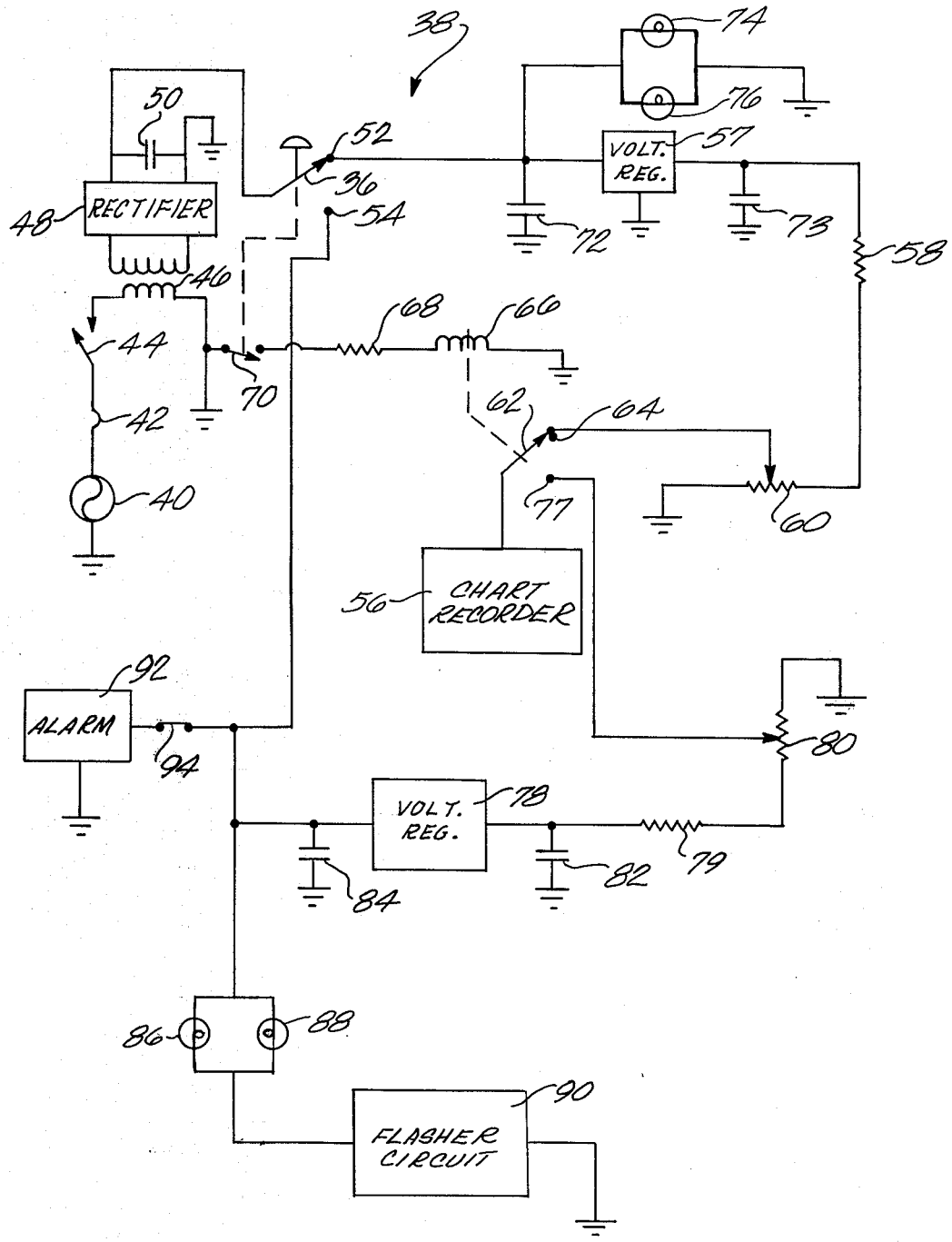
FIG. 2 is a line schematic of the alarm and chart recorder circuit of the present invention.

Circuit 38 is shown in FIG. 2. It includes a source of alternating current 40 in series circuit with a fuse 42 and an on-off switch 44. A transformer 46 reduces the voltage of source 40 to, say 12 volts, and a bridge rectifier 48 rectifies the alternating current to direct current. A capacitor 50 smoothes any surges. Pressure switch 36 is in series circuit with rectifier 48 and has a first pole 52 and a second pole 54. First pole 52 controls a chart recorder 56 and requires that recorder to chart the fact that adequate levels of drilling mud exist above collar 20. Pole 52 is in series circuit with a voltage regulator 57. The regulator drops signal voltage to some predetermined level, say 5 volts. A load resistor 58 in series with voltage regulator 57 is also in series with a potentiometer 60. Relay contacts 62 are in series with potentiometer 60 when the contacts are in circuit with a pole 64 of the relay. Contacts 62 are of relay 66. Relay 66 is in series with power source 40 through a load resistor 68 and contacts 70 of switch 36. Contacts 62 are in the position illustrated when pressure switch 36 provides a circuit to pole 52. When pole 52 is in circuit, chart recorder 56 records a signal indicating that the drilling mud level is high enough to be safe. The signal does not vary in amplitude so long as a safe level of drilling mud is present, regardless of the level. Capacitors 72 and 73 on either side of voltage regulator 57 smoothen out fluctuations in signals. Indicator lights 74 and 76 indicate to an operator that the drilling mud level is satisfactorily high. These lights are in series with pole 52.

Thus, when pressure switch 36 senses a pressure higher than a threshold pressure, a circuit is established to the chart recorder. A constant value signal to the chart recorder corresponding to an indication of a safe level of drilling mud operates the recorder. A time plot of this single value signal results.

At a predetermined low pressure corresponding to an unsatisfactory level of drilling mud, pressure switch 36 switches from pole 52 to pole 54. This drops chart recorder 56 out of the circuit to pole 52. Relay 66 is also taken out of circuit with alternating current source 40. Contacts 62 of the relay go to a pole 77 to establish an alternate and different voltage circuit to the chart recorder. This different voltage circuit results in a record or a trace against time of inadequate drilling mud level.

Pole 77 is in series with a voltage regulator 78 through a load resistor 79 and a potentiometer 80. Both of the latter elements are in series with the regulator. Pole 54 is in series with the voltage regulator. The regulator steps the voltage down to pole 77. Capacitors 82 and 84 smoothes fluctuations in the circuit that includes voltage regulator 78 and are on either side of this regulator. Warning lights 86 and 88 are in series with pole 54 and indicate to an operator that something is wrong in the drilling mud circuit. These lights flash because of a flasher circuit 90 between them and ground. An audio alarm 92, through a normally closed switch 94, is in series with pole 54 and sounds an alarm when the drilling mud level gets too low. Switch 94 takes the audio out of circuit.

The present invention provides a very fascile drilling mud level monitor. When drilling mud level gets too low, this fact becomes immediately apparent to an operator by the audio alarm and visual alarm. Yet, the drilling mud level can be allowed to drop some so that during tripping pipe out, dry pipe can be pulled. Further, a continuous history of drilling mud level is available to an operator because of the chart recorder. Because of the rotometer, an indication of drilling mud level even above safe levels and the rate of change of drilling mud level are available to an operator.

The present invention has been described with reference to a preferred embodiment. The spirit and scope of the appended claims, however, should not necessarily be so limited.

What is claimed is:

1. An improvement in drilling mud monitors for drilling mud in petroleum wells being drilled comprising:

(a) means for supplying a stream of air into a casing containing drilling mud at a predetermined level below the ground, such means including a line adapted to be connected to a source of air under pressure;

(b) valve means in the line to adjust the flow of air through the line;

(c) means in the line to indicate visually the rate of flow of air through the line;

(d) pressure switch means in the line responsive to a predetermined low pressure therein to switch between a first position and a second position, the predetermined low pressure corresponding to an inadequate level of drilling mud in the casing;

(e) chart recorder means in circuit with the pressure switch means;

(f) means in circuit with the pressure switch means and the chart recorder to provide different magnitude signals to the chart recorder corresponding, respectively, to the first and second positions of the pressure switch;

whereby, a pressure time history of drilling mud in the well being drilled will be recorded by the chart recorder with one trace corresponding to an adequate level of drilling mud and an alternate trace corresponding to an inadequate level of drilling mud.

2. The improvement claimed in claim 1 including visual alarm means in circuit with the second position of the pressure switch to indicate visually too low a level of drilling mud.

3. The improvement claimed in claim 2 including audio alarm means in circuit with the second position of the pressure switch to indicate audially too low a level of drilling mud.

4. The improvement claimed in claim 3 including first and second voltage regulator means in circuit, respectively, with the first and second positions of the pressure switch to provide different voltages to the chart recorder corresponding to an adequate and inadequate drilling mud level, respectively, in the well being drilled.

5. The improvement claimed in claim 4 including flasher means in circuit with the visual signal means to give a flashing visual signal.

6. The improvement claimed in claim 5 wherein the visual flow rate means includes a rotometer.

7. The improvement claimed in claim 6 wherein a regulator is included in the line to maintain predetermined maximum pressure in the line at the pressure switch.

8. The improvement claimed in claim 3 wherein the visual flow rate means includes a rotometer.

9. The improvement claimed in claim 8 including first and second voltage regulator means in circuit, respectively, with the first and second positions of the pressure switch to provide different voltages to the chart recorder corresponding to an adequate and inadequate drilling mud level, respectively, in the well being drilled.

* * * * *